US006119290A

United States Patent [19]

Masoncup

[11] Patent Number: 6,119,290

[45] Date of Patent: Sep. 19, 2000

[54] DUST RUFFLE STRUCTURE

[76] Inventor: John F. Masoncup, 610 N. Maple Ct., Mount Prospect, Ill. 60056

[21] Appl. No.: 08/892,741

[22] Filed: Jul. 15, 1997

[51] Int. Cl.[7] ..... A47G 21/00

[52] U.S. Cl. ..... 5/493; 5/482; 5/499; 5/486

[58] Field of Search ..... 5/493, 482, 499, 5/486, 923, 497, 500

[56] References Cited

U.S. PATENT DOCUMENTS

| | | | |
|---|---|---|---|
| 2,245,779 | 6/1941 | Heil | 5/493 |
| 2,641,001 | 6/1953 | Krasnov . | |
| 2,763,875 | 9/1956 | Piontkowski . | |
| 4,413,368 | 11/1983 | Schuetze . | |
| 4,445,242 | 5/1984 | Bowen . | |
| 4,488,323 | 12/1984 | Colburn . | |
| 4,651,370 | 3/1987 | Vitale . | |
| 4,916,766 | 4/1990 | Grandy . | |
| 5,042,099 | 8/1991 | Brenner et al. . | |
| 5,086,531 | 2/1992 | Carlos . | |
| 5,271,112 | 12/1993 | Bible et al. . | |
| 5,335,383 | 8/1994 | Schwind . | |
| 5,404,601 | 4/1995 | Oneill et al. | 5/493 |
| 5,621,931 | 4/1997 | Hamilton | 5/482 |
| 5,638,562 | 6/1997 | Masoncup | 5/482 |

*Primary Examiner*—Terry Lee Melius
*Assistant Examiner*—Fredrick Conley
*Attorney, Agent, or Firm*—Charles F. Meroni, Jr; Meroni & Meroni

[57] ABSTRACT

A dust ruffle structure sized and shaped to be positioned on and around a lower supporting structure and underneath an upper mattress on a bed comprising: a sheet of dust ruffle material, the sheet of dust ruffle material being long enough to embrace sides of the bed, and a friction fastening structure. The friction fastening structure has a non-slip, friction surface, the friction fastening structure is secured along the length of the sheet of dust ruffle material at an upper edge thereof, whereby the upper edge of the sheet of dust ruffle material can then be tucked by a person's fingers a desired distance underneath the upper mattress in between the upper mattress and the lower supporting structure. The desired distance is sufficient to enable a weight of the upper mattress to compress against the friction fastening structure, wherein the combination of the weight of the upper mattress and a friction force of the friction fastening structure coact to keep the dust ruffle structure securely in between the upper mattress and the lower supporting structure and further provide a resistance from pulling the dust ruffle structure out of an adjusted position.

28 Claims, 4 Drawing Sheets

DUST RUFFLE STRUCTURE

BACKGROUND OF THE INVENTION

1. Field of the Invention

The present invention relates generally to a dust ruffle structure for placement onto and around a box spring of a bed. More particularly I have provided a dust ruffle structure capable of being easily installed and adjusted for proper length and width on a mattress foundation to avoid any need to remove an upper mattress therefrom and to avoid any need for lifting the mattress foundation. Furthermore, my dust ruffle structure is easily removable from a mattress foundation without the need to lift the mattress foundation and without the need to unfasten the dust ruffle structure from specific fasteners positioned on the dust ruffle. I have further provided a dust ruffle structure that is easy to manufacture by allowing existing dust ruffle skirting material to be easily modified in accordance with the present invention.

2. Description of the Prior Art

Conventional dust ruffles comprise a ruffled type skirt that is attached around the edges of a sheet. The dust ruffle and sheet are sized to be placed onto a lower mattress portion or a box spring of a bed. In order to install or remove a conventional dust ruffle from a bed one must generally remove the upper mattress and possibly also lift the box spring. Dust ruffles are seldom removed from beds because of the difficulty involved in removing the upper mattress and possibly lifting the box spring.

Other dust ruffles require the use of special fasteners to securely attach the dust ruffle to a bed. For example, the dust ruffle described in U.S. Pat. No. 5,086,531 discloses the use of a dust ruffle that extends around the edges of a box spring and is attached with fasteners along the upper edge of the dust ruffle to opposing fasteners positioned on the upper edge of the box spring. This type of dust ruffle requires one to have special fasteners positioned on the box spring, and further requires one to specifically fasten the dust ruffle to each fastener in a time consuming manual method. Since not all beds are the same height, one is required to have a dust ruffle of a predetermined exact width for each bed, otherwise the dust ruffle may be too wide thereby having an excessive amount of dust ruffle material on the floor, or the dust ruffle may not be wide enough thereby exposing too much of the bed structure from underneath the dust ruffle.

There have been various types of dust ruffles available in the marketplace, but none have gained widespread acceptance because of their difficulty of installation and removal. In addition, other types of dust ruffles require constant readjustment of the dust ruffle when the bed is made. It is therefore desirable to provide a dust ruffle structure that can be quickly and easily installed, quickly and easily removed, and is adjustable to accommodate various bed heights.

These and other types of dust ruffles disclosed in the prior art do not offer the flexibility and inventive features of my improved dust ruffle. As will be described in greater detail hereinafter, the improved dust ruffle structure of the present invention differs from those previously proposed.

SUMMARY OF THE INVENTION

In accordance with one embodiment of my present invention I have provided a dust ruffle structure sized and shaped to be positioned on and around a lower supporting structure and underneath an upper mattress on a bed comprising: a sheet of dust ruffle material, the sheet of dust ruffle material being long enough to embrace sides of the bed, and a friction fastening structure. The friction fastening structure has a non-slip, friction surface, the friction fastening structure is secured along the length of the sheet of dust ruffle material at an upper edge thereof, whereby the upper edge of the sheet of dust ruffle material can then be tucked by a person's fingers a desired distance underneath the upper mattress in between the upper mattress and the lower supporting structure. The desired distance is sufficient to enable a weight of the upper mattress to compress against the friction fastening structure, wherein the combination of the weight of the upper mattress and a friction force of the friction fastening structure coact to keep the dust ruffle structure securely in between the upper mattress and the lower supporting structure and further provide a resistance from pulling the dust ruffle structure out of an adjusted position.

A further objective of this invention is to provide a dust ruffle structure as described above, wherein the friction fastening structure is comprised of a material selected from the group consisting of: rubber, synthetic rubber, cellular rubber, foam rubber, plastic, and cloth.

Yet a further objective of this invention is to provide a dust ruffle structure as described above, wherein the friction fastening structure is attached along an outer edge on the sheet of dust ruffle material, whereby when the dust ruffle structure is tucked in between the upper mattress and the lower supporting structure, the friction fastening structure abuts the upper mattress.

Still another object of the present invention is to provide a dust ruffle structure as described above, wherein the friction fastening structure is attached along an inner edge on the sheet of dust ruffle material, whereby when the dust ruffle structure is tucked in between the upper mattress and the lower supporting structure, the friction fastening structure abuts the lower supporting structure.

A still further object of this invention is to provide a dust ruffle structure as described above, wherein the friction fastening structure is attached along an inner and outer edge on the sheet of dust ruffle material, whereby when the dust ruffle structure is tucked in between the upper mattress and the lower supporting structure, the friction fastening structure abuts the lower supporting structure and the upper mattress.

Another objective of this invention is to provide a dust ruffle structure that extends along three edges of a box spring on an end of the box spring opposite to a head end of a bed.

Still another objective of this invention is to provide a dust ruffle structure that has an external decorative configuration.

A further objective of this invention is to provide a dust ruffle structure that is wide enough to cover a space between a mattress and a supporting floor surface.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
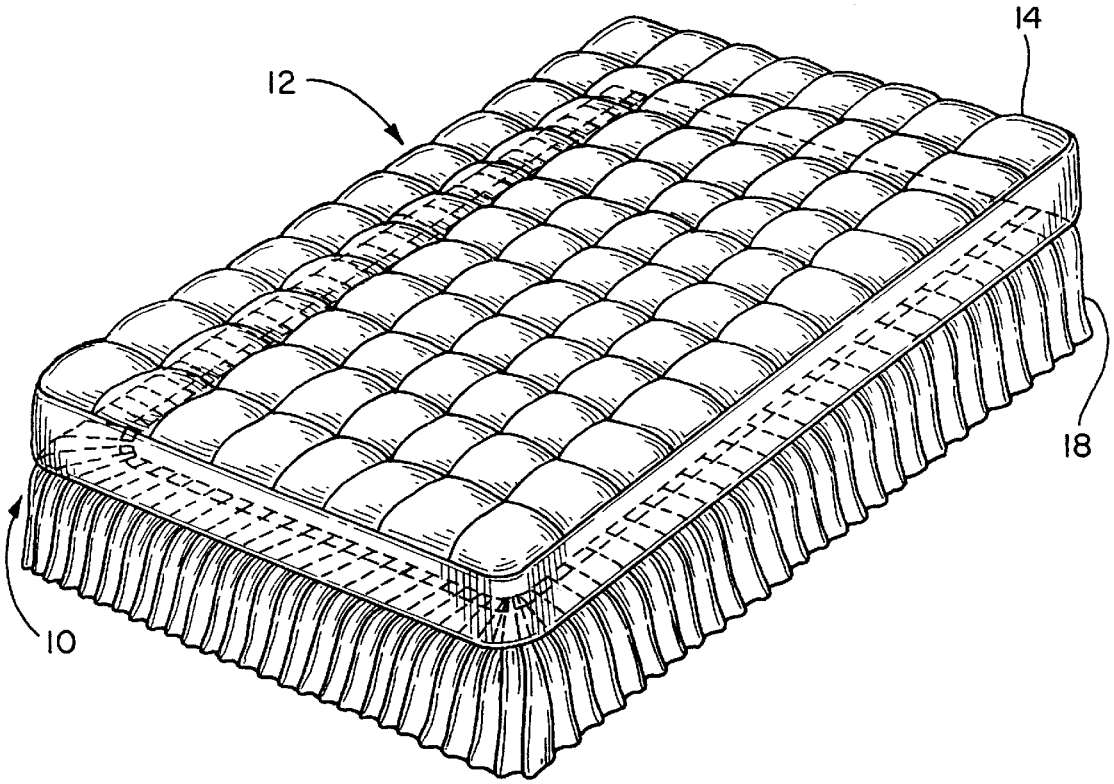
FIG. 1 is a perspective view of a bed utilizing my improved dust ruffle in accordance with the present invention.
Figure 2:
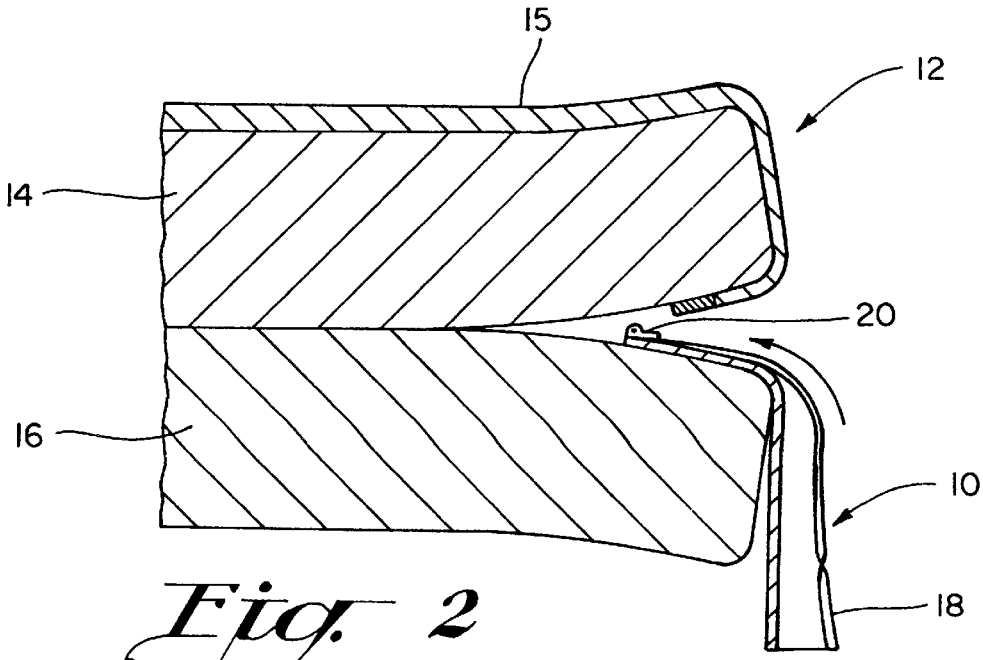
FIG. 2 is a partial cross-sectional view showing how my improved dust ruffle is installed on a mattress foundation.
Figure 3:
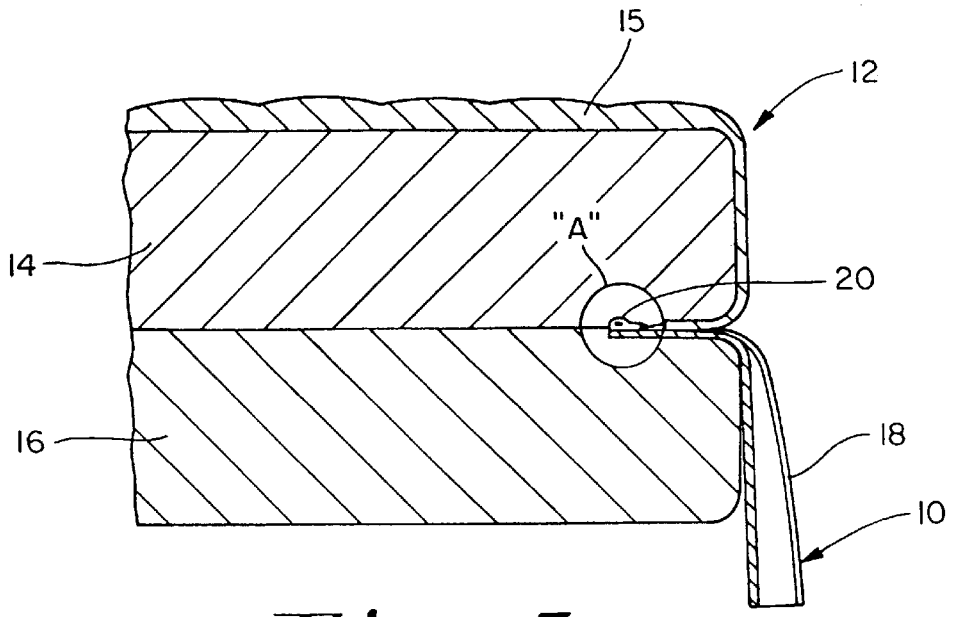
FIG. 3 is a partial cross-sectional view showing how my improved dust ruffle is installed and tucked in between a mattress and a box spring.

Referring now to the drawings, FIGS. 1–3 show my new and improved dust ruffle structure 10 installed on and around a bed 12 having an upper mattress 14 with a fitted bed sheet 15 attached thereto, and a lower supporting structure or box spring 16. The lower supporting structure 16 is not required to be a box spring since this invention can still be used without a box spring. The dust ruffle structure 10 is adapted to be positioned on and around the lower supporting structure 16 and underneath the upper mattress 14.

Figure 4:
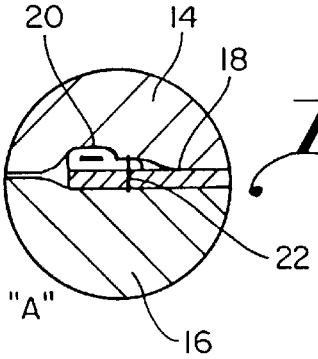
FIG. 4 is an enlarged cross-sectional view of the encircled area A in FIG. 3 showing how my improved dust ruffle is secured underneath an upper mattress.

The dust ruffle structure comprises a sheet of dust ruffle material or skirting material 18, and a friction fastening structure 20. The sheet of dust ruffle material 18 is long enough to embrace sides of the bed, and is wide enough to drape down alongside the bed. The friction fastening structure 20 is secured along the length of the sheet of dust ruffle material 18 at an upper edge thereof. Excellent results are obtained when the friction fastening structure 20 is stitched with thread 22 to the dust ruffle material 18 (FIG. 4), however, other methods of securing the fastening structure can also be used, such as adhesively securing the fastening structure to dust ruffle.

The friction fastening structure 20 is designed to have a non-slip surface that provides a sufficient friction to keep a dust ruffle from falling out from underneath the upper mattress 14 when the weight of the upper mattress 14 is applied thereon. The weight of the upper mattress on the friction fastening structure is sufficient to provide an adequate compression against the friction fastening structure 20 to prohibit the dust ruffle structure from easily falling out of place.

Figure 5:
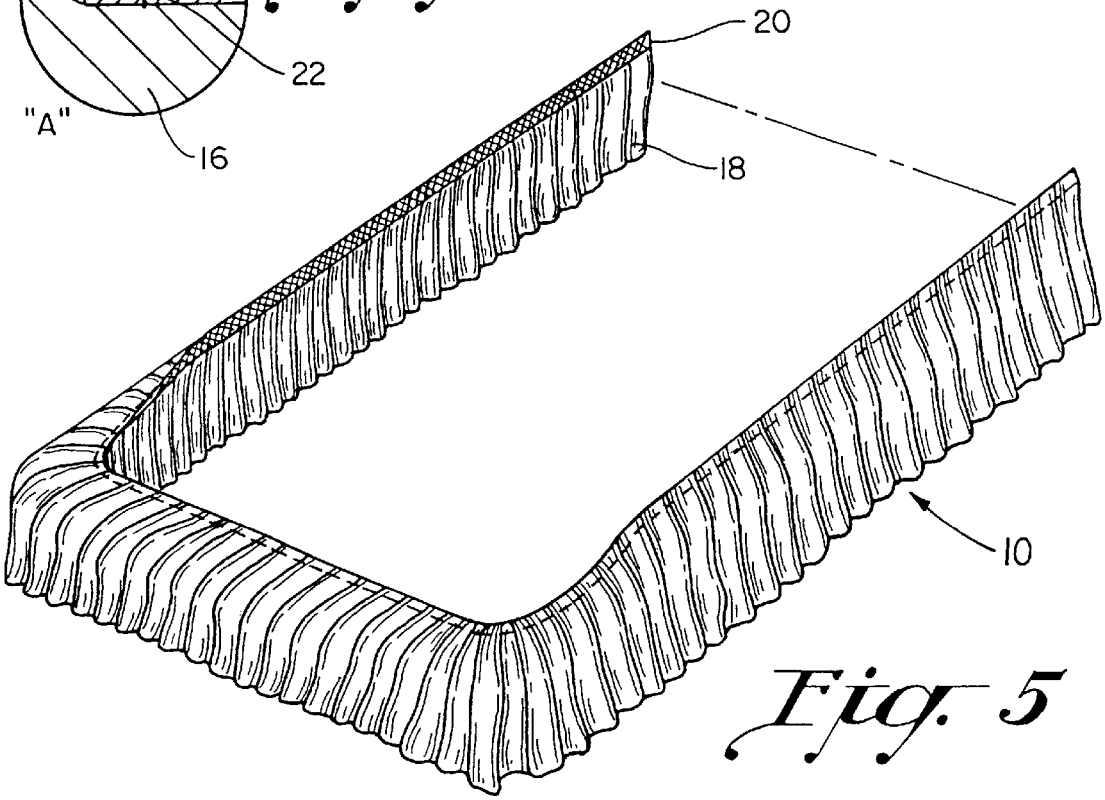
FIG. 5 is a perspective view of my improved dust ruffle in accordance with the present invention.

The length of the dust ruffle structure 10 is sized to fit around the three ends opposite to a head end of a bed (FIG. 5), however, that dust ruffle can be sized to accommodate as many sides as the user would like. The dust ruffle is not normally visible on a bed having a head piece, however, a bed with four open ends can accommodate a dust ruffle on all four sides without requiring one to lift a mattress. Excellent results can be obtained when the user is provided with a dust ruffle structure that is long enough to embrace all four sides of a bed, thereby allowing the user determine the proper length of the dust ruffle and then cutting off any excess material with a pair of scissors. Since the dust ruffle structure is one continuous piece, ironing the dust ruffle of the present invention is easier than ironing a standard type dust ruffle attached with a flat sheet.

To install the dust ruffle structure 10 onto a bed, the upper edge of the sheet of dust ruffle material 18 is tucked by a person's fingers a desired distance underneath the upper mattress 14 in between the upper mattress and the lower supporting structure 16. The desired distance is sufficient to enable a weight of the upper mattress to compress against the friction fastening structure 20, wherein the combination of the weight of the upper mattress and a friction force of the friction fastening structure coact to keep the dust ruffle structure 10 securely in between the upper mattress and the lower supporting structure and further provide a resistance from pulling the dust ruffle structure out of an adjusted position. Since not all beds have the same height due to varying widths of box springs and variable heights of bed frames, the dust ruffle structure 10 of the present invention can be tucked underneath the upper mattress 14 as much as is desired in accordance to the height of the bed, thereby providing a universal dust ruffle structure that drapes down alongside a bed at a proper width. Excellent results are obtained when the dust ruffle structure 10 is tucked underneath the upper mattress at least two inches. The average distance between the lower surface of the upper mattress and the supporting floor surface the bed is situated on ranges between 12 to 22 inches, therefore excellent results can be obtained when the dust ruffle structure is 24 inches wide.

The friction fastening structure can be composed of virtually any material that can provide a sufficient friction in between a mattress and box spring to hold a dust ruffle in place. Materials that can be used to provide a sufficient friction include: rubber, synthetic rubber, cellular rubber, foam rubber, plastic, and cloth. One form of plastic that could be considered can be a relatively firm plastic providing sharp gripping edges to help resist the dust ruffle structure from being pulled-out. The friction fastening material only needs to be approximately ⅛ inch wide and can extend across the entire length of the dust ruffle at an upper edge thereof. It is contemplated that the friction fastening structure can be placed in sections at intervals across the upper edge of the dust ruffle material, however, this would reduce the gripping action of the friction fastening structure and may increase the cost of manufacturing the dust ruffle structure. The friction fastening structure can be as wide as 2 inches, or narrow as 1/16 inch. However, the width of the friction fastening structure depends on the type of material that is being used, the amount of friction the material provides, and the ability to secure the material to the upper edge of the dust ruffle. It is contemplated that the material used for the friction fastening structure be durable so that the gripping action of the friction fastening structure does not deteriorate after being washed and dried several times. The friction fastening structure should be of such construction to provide a resistance factor for securing a horizontally disposed edge of a dust ruffle so that it cannot be easily pulled out when engaged between confronting surfaces of an upper and lower mattress. The resistance created by the friction fastening structure is to be greater than the friction created by a standard sheet of dust ruffle material.

The dust ruffle structure of the present invention does not employ the use of strategically placed elasticized edges to hug corners of a mattress. Elasticized edges would require constant readjustment of the dust ruffle and also add to the expense of manufacturing. Furthermore, the dust ruffle structure of the present invention can be used with beds of various shapes and sizes, including circular beds, heart shaped beds, and the like.

Figure 6:
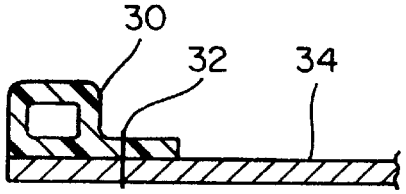
FIG. 6 is an enlarged partial cross-sectional side view of my improved dust ruffle illustrating one version of a friction fastening structure on my dust ruffle.

An example of a friction fastening structure that provides adequate support is shown in FIG. 6. The friction fastening structure 30 is secured by a stitch 32 to the dust ruffle material 34. This particular friction fastening structure is made of a cellular rubber and can be obtained at most hardware stores as weatherstrip material. More specifically, this weatherstrip is manufacture by Macklanburg-Duncan in Oklahoma City, Okla., and is available under the name "Sub-Zero Premium Weatherstrip P-Profile EPDM". This particular friction fastening structure provides additional resistance due to a protruding hump.

Figure 7:
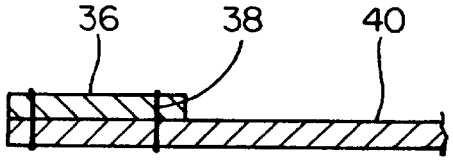
FIG. 7 is an enlarged partial cross-sectional side view of my improved dust ruffle illustrating a second version of a friction fastening structure on my dust ruffle.

Another example of a friction fastening structure is illustrated in FIG. 7. The friction fastening structure 36 is secured by stitches 38 to a sheet of dust ruffle material 40. This friction fastening structure can be made of the various material described above, including the gripping-type material found on the inside waist belt of Sansabelt® trousers.

Figure 8:
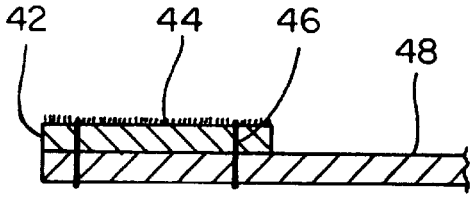
FIG. 8 is an enlarged partial cross-sectional side view of my improved dust ruffle illustrating a third version of a friction fastening structure on my dust ruffle.

Yet another embodiment of a friction fastening structure is shown in FIG. 8. The friction fastening structure 42 has bristles 44 that are inclined in one direction to grip against any material that is rubbed against the direction of the bristles. The bristles should be of such construction and/or fiber configuration to provide a resistance factor for securing a horizontally disposed edge of a dust ruffle so that it cannot be easily pulled out when engaged between confronting surfaces of a lower supporting surface and an upper mattress. This friction fastening structure 42 can be secured by stitching 46 to the dust ruffle material 48.

Figure 9:
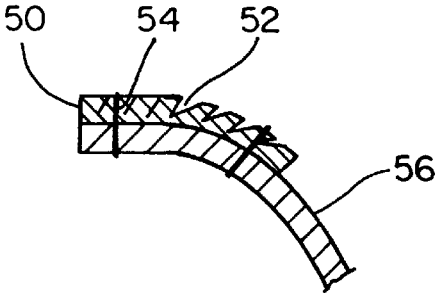
FIG. 9 is an enlarged partial cross-sectional side view of my improved dust ruffle illustrating a fourth version of a friction fastening structure on my dust ruffle.

Still a further embodiment of a friction fastening structure is shown in FIG. 9. The friction fastening structure 50 is composed of a flexible gripping material, such as rubber or plastic, and includes slits 52 that help the material grip against any opposing material. This friction fastening structure 50 can be secured by stitching 54 to the dust ruffle material 56.

Figure 10:
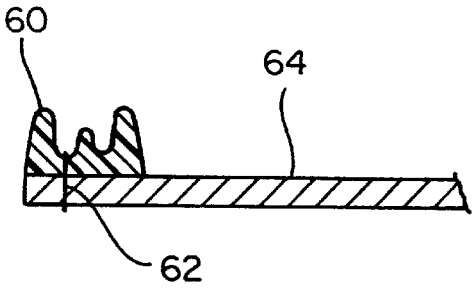
FIG. 10 is an enlarged partial cross-sectional side view of my improved dust ruffle illustrating another version of a friction fastening structure on my dust ruffle.

FIG. 10 illustrates an other version of a weatherstrip material (K-profile) made of cellular rubber manufactured by Macklanburg-Duncan that is suitable as a friction fastening structure. This friction fastening structure 60 is secured by a stitch 62 to the dust ruffle material 64. This particular friction fastening structure 60 provides three small protruding humps that help providing a gripping action against abutting material.

Figure 11:
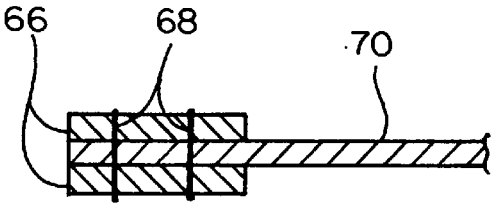
FIG. 11 is an enlarged partial cross-sectional side view of my improved dust ruffle illustrating yet another version of a friction fastening structure on my dust ruffle.

The friction fastening structure can be attached along an inner and/or outer edge on the sheet of dust ruffle material. The friction fastening structure will hold a dust ruffle structure in place regardless of whether it is abutting the upper mattress, the box spring, or both. FIG. 11 illustrates a friction fastening structure 66 secured by stitches 68 on both sides of the dust ruffle material 70.

Figure 12:
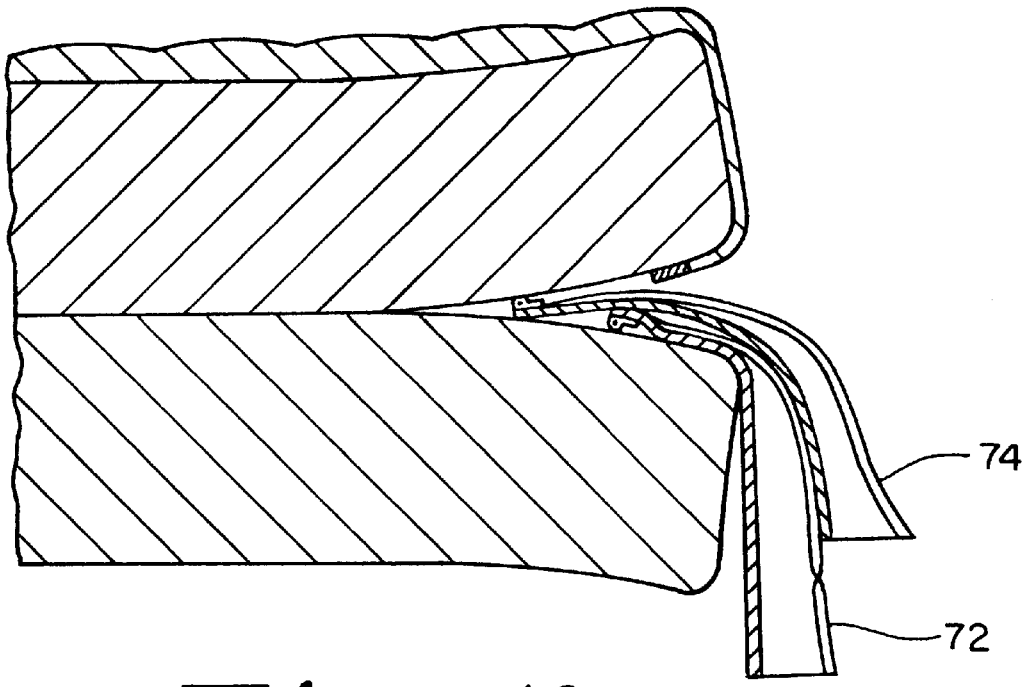
FIG. 12 is a partial cross-sectional view showing how two of my improved dust ruffles are installed on a mattress foundation in a decorative fashion.

My dust ruffle structure can be used on a bed in various different ways. FIG. 12 shows how one can create a layered dust ruffle using two dust ruffle structures 72, 74 with one dust ruffle 74 slightly overlapping another dust ruffle 72. This type of layered dust ruffle provides for a different visual decorative effect.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A dust ruffle structure sized and shaped to be positioned on and around a lower supporting structure and underneath an upper mattress on a bed comprising: a sheet of dust ruffle material, said sheet of dust ruffle material having a length long enough for embracing sides of the bed, and a friction fastening means, said friction fastening means having a non-slip, friction surface, said friction fastening means being secured along the length of the sheet of dust ruffle material at an upper edge thereof, whereby said upper edge of the sheet of dust ruffle material can then be tucked by a person's fingers a desired distance for placement underneath the upper mattress in between the upper mattress and the lower supporting structure, said desired distance being sufficient for enabling a weight of the upper mattress to compress against the friction fastening means, wherein the combination of said weight of the upper mattress and a friction force of said friction fastening means coact for keeping the dust ruffle structure securely in between the upper mattress and the lower supporting structure and further provide a resistance from pulling the dust ruffle structure out of an adjusted position, said non slip surface secured on an outer side along the upper edge of the dust ruffle structure.

2. The dust ruffle structure of claim 1, wherein said sheet of dust ruffle material has an external decorative configuration.

3. The dust ruffle structure of claim 1, wherein said dust ruffle structure has a universal width sufficient for allowing the dust ruffle structure to be used with beds having varying heights, thereby allowing a user to cover a desired space between an upper mattress and a supporting floor surface by tucking the upper edge of the sheet of dust ruffle material a sufficient distance underneath the upper mattress.

4. In a dust ruffle structure for use on a bed with a lower supporting structure underneath an upper mattress having opposed fabric surfaces, the improvement comprising a dust ruffle structure having: a sheet of dust ruffle material, said sheet of dust ruffle material having a length long enough to embrace at least 3 sides of the bed, and a friction fastening means, said friction fastening means having a non-slip, friction surface, said non slip friction surface being secured along the entire length of the sheet of dust ruffle material for disposition along an outer edge opposite the lower supporting structure at an upper edge thereof and sized for abutting the upper mattress whereby said upper edge of the sheet of dust ruffle material can then be tucked by a person's fingers a desired distance underneath the upper mattress in between the upper mattress and the lower supporting structure, said desired distance being sufficient to enable a weight of the upper mattress to compress against the friction fastening means, wherein the combination of said weight of the upper mattress and a friction force of said friction fastening means coact to keep the dust ruffle structure securely engaged between and with the opposed fabric surfaces of the upper mattress and the lower supporting structure and further provide a resistance from pulling the dust ruffle structure out of an adjusted position.

5. The dust ruffle structure of claim 4 wherein the friction fastening means comprises a continuous offset bead of material selected from the group consisting of rubber, synthetic rubber, cellular rubber, foam rubber, plastic, and cloth which is sized and shaped to be pressed into the opposed fabric surfaces of the upper mattress and the lower supporting structure thus resisting pull out of the friction fastening means from between the opposed surfaces of the upper mattress and the lower supporting structure.

6. The dust ruffle structure of claim 4 wherein said friction fastening means comprises a cellular rubber of rubber strip material secured along at least three sides of the length of the sheet of dust ruffle material at an upper edge thereof for embedded engagement with opposing surfaces of the lower supporting structure and the upper mattress.

7. A dust ruffle structure sized and shaped to be positioned on and around a lower supporting structure and underneath an upper mattress on a bed comprising: a sheet of dust ruffle material, said sheet of dust ruffle material having a length long enough to embrace sides of the bed, and a friction fastening means, said friction fastening means having a non-slip, friction surface, said friction fastening means being secured along the length of the sheet of dust ruffle material at an upper edge thereof, whereby said upper edge of the sheet of dust ruffle material can then be tucked by a person's fingers a desired distance underneath the upper mattress in between the upper mattress and the lower supporting structure, said desired distance being sufficient to enable a weight of the upper mattress to compress against the friction fastening means, wherein the combination of said weight of the upper mattress and a friction force of said friction fastening means coact to keep the dust ruffle structure securely in between the upper mattress and the lower supporting structure and further provide a resistance from pulling the dust ruffle structure out of an adjusted position, said friction fastening means comprising a cellular rubber of rubber strip material secured along at least three sides of the length of the sheet of dust ruffle material at an upper edge thereof for embedded engagement with opposing surfaces of the lower supporting structure and the upper mattress.

8. A dust ruffle structure sized and shaped to be positioned on and around a lower supporting structure and underneath an upper mattress on a bed comprising: a length of dust ruffle material, said length of dust ruffle material having a length long enough for embracing sides of the bed, and a friction fastening means, said friction fastening means having a non-slip, friction surface, said friction fastening means being comprised of a material selected from the group consisting of: rubber, synthetic rubber, cellular rubber, foam rubber, plastic, and cloth, said friction fastening means being secured along the length of dust ruffle material at an upper edge thereof, whereby said upper edge of the length of dust ruffle material can then be tucked by a person's fingers a desired distance for placement underneath the upper mattress in between the upper mattress and the lower supporting structure, said desired distance being sufficient for enabling a weight of the upper mattress to compress against the friction fastening means, wherein the combination of said weight of the upper mattress and a friction force of said friction fastening means coact for keeping the dust ruffle structure securely in between the upper mattress and the lower supporting structure and further provide a resistance from pulling the dust ruffle structure out of an adjusted position, said non slip surface secured on an outer side along the upper edge of the dust ruffle structure.

9. The dust ruffle structure of claim 8, wherein said friction fastening means is attached along an outer edge on said length of dust ruffle material, whereby when said dust ruffle structure is tucked for placement in between the upper mattress and the lower supporting structure, said friction fastening means abuts the upper mattress.

10. The dust ruffle structure of claim 8, wherein said friction fastening means is attached along an inner edge on said length of dust ruffle material, whereby when said dust ruffle is tucked for placement in between the upper mattress and the lower supporting structure, said friction fastening means abuts the lower supporting structure.

11. The dust ruffle structure of claim 8, wherein said friction fastening means is attached along an inner and outer edge on said length of dust ruffle material, whereby when said dust ruffle structure is tucked for placement in between the upper mattress and the lower supporting structure, said friction fastening means abuts the lower supporting structure and the upper mattress.

12. The dust ruffle structure of claim 8, wherein said dust ruffle structure has a universal width sufficient for allowing the dust ruffle structure to be used on beds having varying heights, thereby allowing a user to cover a desired space between an upper mattress and a supporting floor surface by tucking the upper edge of the sheet of dust ruffle material a sufficient distance underneath the upper mattress.

13. In combination, a dust ruffle structure and a bed, said dust ruffle structure adapted to be positioned on and around a lower supporting structure and underneath an upper mattress on the bed, said dust ruffle structure comprising: a sheet of dust ruffle material, said sheet of dust ruffle material having a length long enough to embrace at least 3 sides of the bed, and a friction fastening means, said friction fastening means having a non-slip, friction surface, said non slip friction surface being secured along the entire length of the sheet of dust ruffle material along an outer edge opposite said lower supporting structure at an upper edge thereof and abutting said upper mattress, whereby said upper edge of the sheet of dust ruffle material can then be tucked by a person's fingers a desired distance underneath the upper mattress in between the upper mattress and the lower supporting structure, said desired distance being sufficient to enable a weight of the upper mattress to compress against the friction fastening means, wherein the combination of said weight of the upper mattress and a friction force of said friction fastening means coact to keep the dust ruffle structure securely in between the upper mattress and the lower supporting structure and further provide a resistance from pulling the dust ruffle structure out of an adjusted position.

14. The combination of claim 13, wherein said friction fastening means is comprised of a material selected from the group consisting of rubber, synthetic rubber, cellular rubber, foam rubber, plastic, and cloth.

15. The combination of claim 13, wherein said friction fastening means is attached along an outer edge on said sheet of dust ruffle material, whereby when said dust ruffle structure is tucked in between the upper mattress and the lower supporting structure, said friction fastening means abuts the upper mattress.

16. The combination of claim 13, wherein said friction fastening means is attached along an inner edge on said sheet of dust ruffle material, whereby when said dust ruffle is tucked in between the upper mattress and the lower supporting structure, said friction fastening means abuts the lower supporting structure.

17. The combination of claim 13, wherein said friction fastening means is attached along an inner and outer edge on said sheet of dust ruffle material, whereby when said dust ruffle structure is tucked in between the upper mattress and the lower supporting structure, said friction fastening means abuts the lower supporting structure and the upper mattress.

18. The combination of claim 13, wherein said dust ruffle structure extends along three edges of a box spring on an end of the box spring opposite to a head end of a bed.

19. The combination of claim 13, wherein said dust ruffle structure is wide enough to cover a space between an upper mattress and a supporting floor surface.

20. The combination of claim 13, wherein said sheet of dust ruffle material has an external decorative configuration.

21. The combination of claim 13, wherein said dust ruffle structure has a universal width sufficient for allowing the dust ruffle structure to be used on beds having varying heights, thereby allowing a user to cover a desired space between the upper mattress and a supporting floor surface by tucking the upper edge of the sheet of dust ruffle material a sufficient distance underneath the upper mattress.

22. The combination of claim 13, wherein said friction fastening means comprises a cellular rubber of rubber strip material secured along at least three sides of the length of the sheet of dust ruffle material at an upper edge thereof for engagement with an opposing surface of the upper mattress.

23. The dust ruffle structure of claim 22, wherein said friction fastening means is attached along an outer edge on said sheet of dust ruffle material, whereby when said dust ruffle structure is tucked for placement in between the upper mattress and the lower supporting structure, said friction fastening means abuts the upper mattress.

24. The dust ruffle structure of claim 22, wherein said friction fastening means is attached along an inner edge on said sheet of dust ruffle material, whereby when said dust ruffle is tucked for placement in between upper mattress and the lower supporting structure, said friction fastening means abuts the lower supporting structure.

25. The dust ruffle structure of claim 22, wherein said friction fastening means is attached along an inner and outer edge on said sheet of dust ruffle material, whereby when said dust ruffle structure is tucked for placement in between the upper mattress and the lower supporting structure, said friction fastening means abuts the lower supporting structure and the upper mattress.

26. The dust ruffle structure of claim 22, wherein said dust ruffle structure has a sufficient length for extending along three edges of a box spring on an end of the box spring opposite to a head end of a bed.

27. The dust ruffle structure of claim 22, wherein said dust ruffle structure has a sufficient width for covering a space between an upper mattress and a supporting floor surface.

28. The dust ruffle structure of claim 22, wherein said friction fastening means is comprised of a material selected from the group consisting of: rubber, synthetic rubber, cellular rubber, foam rubber, plastic, and cloth.

* * * * *